US009683340B2

(12) United States Patent
Sicking et al.

(10) Patent No.: US 9,683,340 B2
(45) Date of Patent: Jun. 20, 2017

(54) SYSTEMS AND METHODS FOR SUPPORTING BOLLARDS

(71) Applicant: THE UAB RESEARCH FOUNDATION, Birmingham, AL (US)

(72) Inventors: Dean Sicking, Indian Springs Village, AL (US); David Littlefield, Vestavia Hills, AL (US); Kenneth Walls, Moody, AL (US)

(73) Assignee: The UAB Research Foundation, Birmingham, AL (US)

( * ) Notice: Subject to any disclaimer, the term of this patent is extended or adjusted under 35 U.S.C. 154(b) by 0 days.

(21) Appl. No.: 14/911,790

(22) PCT Filed: Aug. 13, 2014

(86) PCT No.: PCT/US2014/050869
§ 371 (c)(1),
(2) Date: Feb. 12, 2016

(87) PCT Pub. No.: WO2015/023739
PCT Pub. Date: Feb. 19, 2015

(65) Prior Publication Data

US 2016/0194841 A1 Jul. 7, 2016

Related U.S. Application Data

(60) Provisional application No. 61/865,413, filed on Aug. 13, 2013.

(51) Int. Cl.
*E01F 13/00* (2006.01)
*E01F 15/00* (2006.01)
(Continued)

(52) U.S. Cl.
CPC ..... *E01F 15/003* (2013.01); *E01F 13/12* (2013.01); *E01F 15/146* (2013.01)

(58) Field of Classification Search
CPC ..... E01F 15/003; E01F 15/0461; E01F 13/00
USPC ..... 40/607.01
See application file for complete search history.

(56) References Cited

U.S. PATENT DOCUMENTS 868,065 A 10/1907 Barnes
1,449,518 A * 3/1923 Lawson ..... E01F 15/0438 256/1
(Continued)

FOREIGN PATENT DOCUMENTS

GB 2469382 A 10/2010
GB 2485278 A 5/2012
(Continued)

OTHER PUBLICATIONS

International Search Report for PCT/US2014/050869 mailed Nov. 26, 2014.
Foreign search report dated Jan. 25, 2017 for EP14836584.

*Primary Examiner* — Gary Hartmann
(74) *Attorney, Agent, or Firm* — Thomas | Horstemeyer, LLP

(57) ABSTRACT

In one embodiment, a bollard system includes multiple support beams adapted to be embedded in concrete, multiple bollards, each bollard being attached to a support beam a point near a center of the beam, and a reinforcing bar that is woven between the support beams to provide reinforcement to the system.

20 Claims, 7 Drawing Sheets

(51) Int. Cl.
*E01F 13/12* (2006.01)
*E01F 15/14* (2006.01)

(56) References Cited

U.S. PATENT DOCUMENTS 4,515,499 A 5/1985 Furiate
7,497,640 B2 * 3/2009 Sharp ..... E01F 15/06 256/13.1
7,607,856 B2 * 10/2009 Patel ..... E01F 15/003 404/6
7,699,558 B2 * 4/2010 Adler ..... E01F 13/00 404/6
7,775,738 B2 * 8/2010 Darcy ..... E01F 13/12 256/13.1
8,197,156 B2 * 6/2012 Morgan ..... E01F 13/12 256/13.1
8,215,865 B2 * 7/2012 Adler ..... E01F 13/00 256/13.1
9,127,421 B2 * 9/2015 Ball ..... E01F 13/12
9,133,590 B2 * 9/2015 Ball ..... E01F 15/003
2007/0086858 A1 * 4/2007 Morgan ..... E01F 13/12 404/6
2008/0006807 A1 * 1/2008 Coffey ..... E01F 15/0407 256/24
2008/0112756 A1 5/2008 Omar
2009/0028638 A1 1/2009 Crawford et al.
2010/0322707 A1 * 12/2010 Darcy ..... E01F 13/12 404/6
2012/0308302 A1 * 12/2012 Adler ..... E01F 13/00 404/6

FOREIGN PATENT DOCUMENTS

GB 2487581 A 8/2012
GB 2487613 A 8/2012

* cited by examiner

SYSTEMS AND METHODS FOR SUPPORTING BOLLARDS

CROSS-REFERENCE TO RELATED APPLICATION(S)

This application is the 35 U.S.C. §371 national stage application of PCT Application No. PCT/US2014/050869, filed Aug. 13, 2014, which claims priority to U.S. Provisional Application Ser. No. 61/865,413, filed Aug. 13, 2013, both of which are hereby incorporated by reference herein in their entirety.

BACKGROUND

Bollards are short vertical posts that are often used to obstruct the passage of motor vehicles. In conventional systems, each bollard is attached to a horizontal steel beam that is embedded in concrete. In systems that comprise multiple bollards, multiple steel beams are used (one for each bollard), which are typically parallel to each other. The bollards are attached to the front ends, i.e., the ends that face vehicle traffic, of the beams. Steel rebar mats are typically positioned above and below the beams to reinforce the concrete and limit movement of the beams should a vehicle impact one or more of the bollards.

While the above-described systems function adequately well, these systems are inefficient. When a vehicle impacts a bollard, a moment is applied to the bollard that, if it were not adequately supported, would knock it over. The beam and the rebar mat that lies below the beam are designed to oppose this moment. In order to achieve this, the beam must be relatively long and thick, and therefore requires a large amount of steel to construct. The rebar mats that are provided above and below the beams only add to the amount of steel that is required to fabricate the system. The large amount of steel that is required in such systems unnecessarily increases the costs of the systems.

From the above discussion, it can be appreciated that it would be desirable to have systems and methods for supporting bollards that require less steel.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have systems and methods for supporting bollards that require less steel than conventional systems. Disclosed herein are examples of such systems and methods. In some embodiments, bollards are attached near the centers of support beams of the system instead of the front ends of the beams. When a bollard is struck by an impacting vehicle, the moment applied to its support beam is resisted by both the front (compression) end and the rear (tension) end of the beam. Approximately half of the moment in the bollard will be carried in each direction and, therefore, the peak load on the beam is cut in half. Because of this, the beam need not be as robust and therefore can be made from less material (e.g., steel). In some embodiments, the support beams are reinforced with reinforcing bars that are woven between the beams. The advantage of the woven configuration is that it provides a positive reaction force that resists motion of each adjacent support beam whether the beam is pushed upward or downward.

In the following disclosure, various specific embodiments are described. It is to be understood that those embodiments are example implementations of the disclosed inventions and that alternative embodiments are possible. All such embodiments are intended to fall within the scope of this disclosure.

As described above, bollard systems disclosed herein generally include bollards that are attached near the centers of support beams that are embedded in an appropriate foundation material, such as concrete. Also embedded in the material are one or more reinforcing bars that are woven between the support beams. Described below are multiple embodiments of bollard systems that comprise these general features.

Figure 1A:
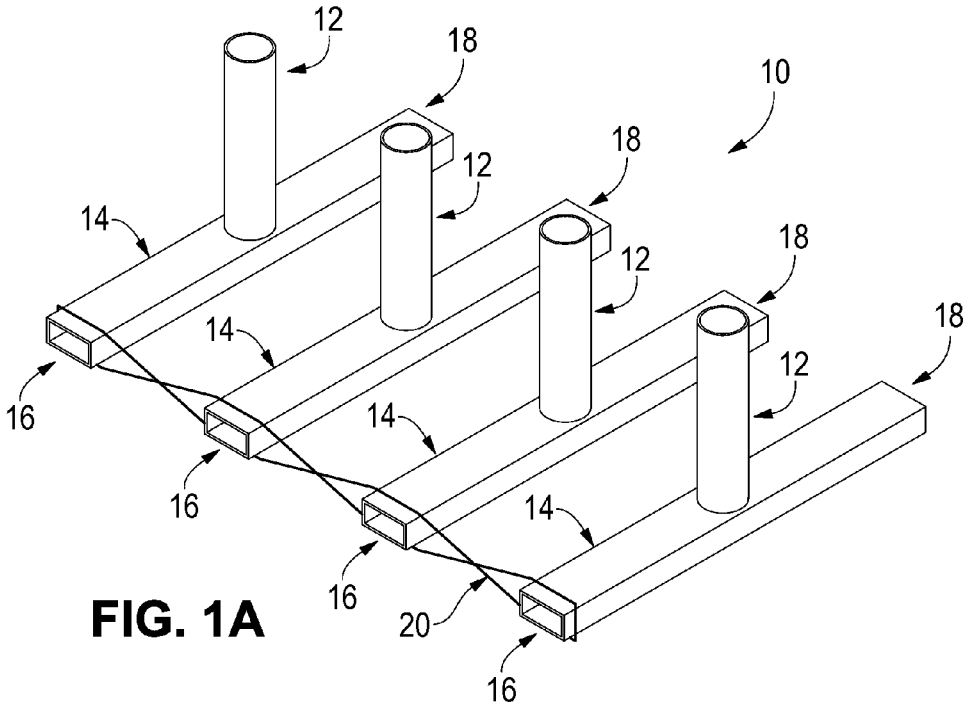
FIG. 1A is a perspective view of a first embodiment of a bollard system.

FIG. 1A illustrates a first bollard system 10. As indicated in this figure, the system 10 includes multiple bollards 12. More particularly, the illustrated system 10 includes four bollards 12. While four bollards 12 are shown, if will be appreciated that the system 10 can include a greater or lesser number of bollards. In some embodiments, each bollard 12 comprises a relatively short elongated vertical member that is designed to withstand the forces associated with an impact from a motor vehicle. By way of example, the bollards 12 can comprise steel pipes or tubes that may or may not be filled with concrete.

Irrespective of its construction, each bollard is attached, for example, welded, to a single support beam 14 near its center (i.e., approximately halfway along its length). Because there are four bollards 12 in the illustrated example, there are four support beams 14 that together form part of the foundation of the bollard system 10. In some embodiments, each support beam 14 is a hollow steel beam having a front end 16, a rear end 18, and a rectangular cross-section.

As mentioned above, positioning the bollards 12 near the centers of the support beams 14 enables the support beams to resist a moment applied to the bollard using both the front (compression) end and the rear (tension) end of the beam. Therefore, approximately half of the moment in the bollard will be carried in each direction along the beam 14 and the peak load on the beam is cut in half. Because of this, the support beams 14 can be made from less material and at less expense.

It is further noted that rotation of the bollard 12 due to vehicular impact will raise the front end 16 of its associated support beam 14. If the bollard 12 rotates as much as 30 degrees and the bollard and support beam 14 do not form a plastic hinge, the front end 16 of the beam may be raised several feet out of the ground. Because the impacting vehicle will be positioned over the support tube 14 at the beginning of the impact, the front end 16 of the raised support beam will likely be snagged by the vehicle, which will deliver high resistance forces without any significant bending load in the beam. In some embodiments, the front ends 16 of the support beams 14 can be optimized to increase the snagging potential and maximize load carrying capacity. For example, the top edges of the front ends 16 can be stiffened and sharpened in order to reduce the size of the snag point needed to engage the beam.

Figure 1B:
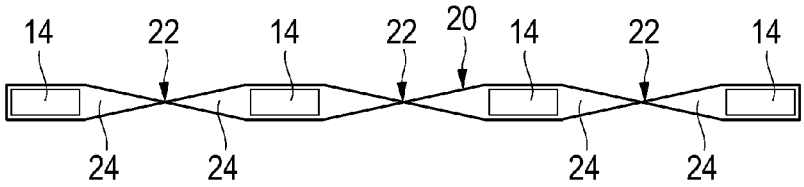
FIG. 1B is a schematic end view of support beams and a woven reinforcement bar of the system of FIG. 1A.
Figure 1C:
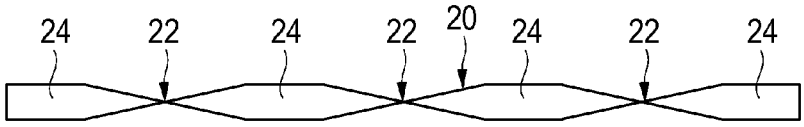
FIG. 1C is a schematic end view of the woven reinforcement bar shown in FIG. 1B.

Woven between at least the front ends 16 of the support beams 14 is a reinforcing bar 20. Notably, a similar reinforcing bar 20 is also woven between the rear ends 18 of the support beams 14. The reinforcing bar 20 is described herein as being "woven" between the beams 14 because it alternately passes over and under adjacent beams in a first direction generally perpendicular and then under and over the same beams in a second direction opposite to the first direction so as to tie the beams together in similar manner to the way in which warp yarns tie together weft yarns in a woven textile. As shown in FIGS. 1B and 1C, the repeated passing over and under the beams 14 in the two directions creates multiple crossover points 22 at which the reinforcing bar crosses over itself and open lobes 24 between the crossover points in which a support beam 14 can be secured. This configuration of the reinforcing bar 20 provides a positive reaction force that resists motion of the beams 14 whether they are pushed up or down. This enables the bollards 12 to be moved from the front ends of the support beams 14 to the centers of the beams, as illustrated in FIG. 1A.

FIG. 1B schematically illustrates the weaving of the reinforcing bar 20 through the support beams 14. In some embodiments, the reinforcing bar 20 is made of steel rebar. In the example of FIG. 1, the reinforcing bar 20 comprises a single, endless bar that forms a continuous woven loop that wraps around the beams 14. FIG. 1C shows the reinforcing bar 20 without the presence of the beams 14.

During construction of the bollard system 10, the support beams 14 and their associated bollards 12 can be positioned at the installation site in the desired locations in an orientation similar to that shown in FIG. 1A. A reinforcing bar 20 can be passed over at least the front ends 16 of the beams 14 and potentially the rear ends 18 of the beams. Once the reinforcing bar(s) 20 is in place, concrete can be poured over the beams 14 and the reinforcing bar(s) 20.

FIGS. 2-7 illustrate alternative bollard systems. In each of these systems, the bollards and the support beams have the same reference numerals and can be assumed to have similar configurations to those described above in relation to FIG. 1. The primary differences between each of the embodiments is the reinforcing bars that are used to reinforce the systems. Therefore, the discussions of FIGS. 2-7 that follow focus on the configurations of the reinforcing bars.

Figure 2A:
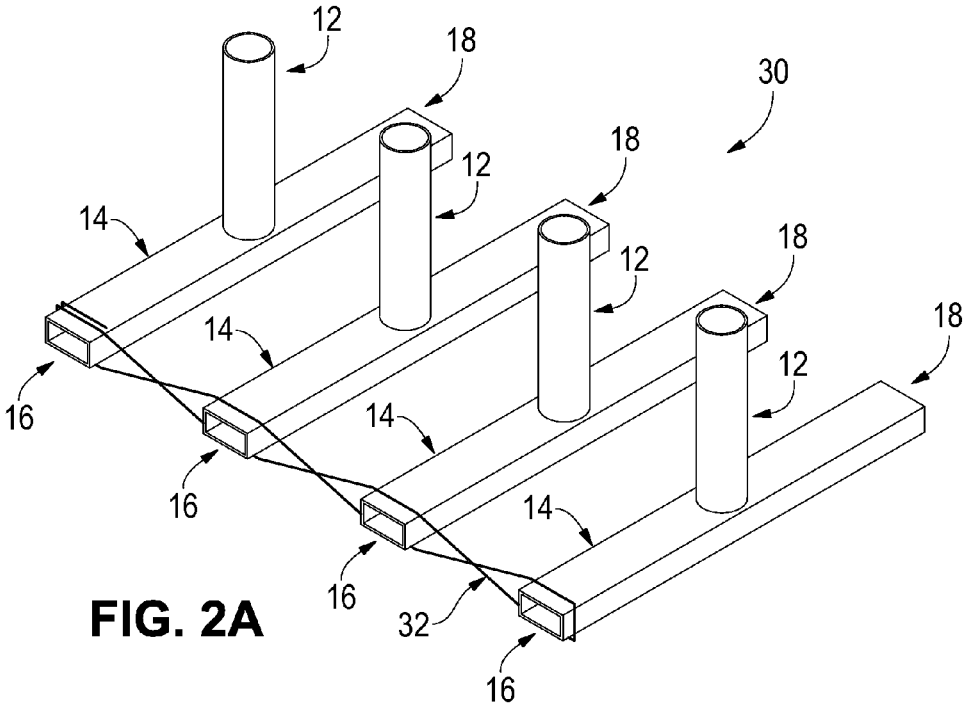
FIG. 2A is a perspective view of a second embodiment of a bollard system.
Figure 2B:
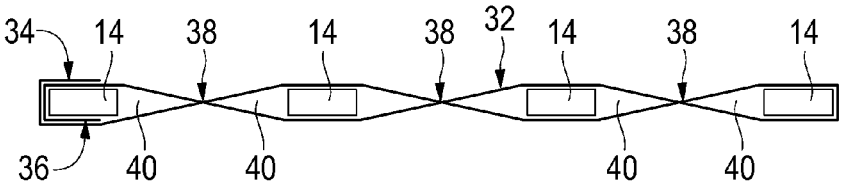
FIG. 2B is a schematic end view of support beams and a woven reinforcement bar of the system of FIG. 2A.
Figure 2C:
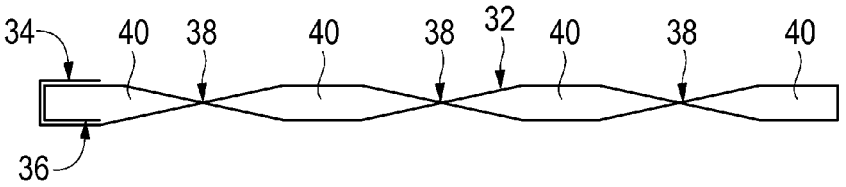
FIG. 2C is a schematic end view of the woven reinforcement bar shown in FIG. 2B.

Turning to FIG. 2A, a bollard system 30 includes bollards 12 that are attached near the centers of support beams 14. Woven between at least the front ends 16 of the beams 14 is a reinforcing bar 32. The reinforcing bar 32 can have a construction similar to that of the reinforcing bar 20 shown in FIG. 1. Therefore, the reinforcing bar can be made of steel rebar. In the embodiment of FIG. 2, however, the reinforcing bar 32 is not endless and therefore has free ends 34 and 36. In the illustrated example, the free ends 34, 36 form hooks that wrap around one of the beams 14 (the leftmost beam in FIGS. 2A and 2B). As shown most clearly in FIGS. 2B and 2C, the lengths of the reinforcing bar 32 forming these hooks form an overlapping region in which the lengths run parallel to each other. This overlap provides resistance to tensile forces in the circumstance of a vehicle impacting one of the bollards 14. The amount of overlap may vary depending upon the application. As before, the weaving of the reinforcing bar 32 between the breams 14 creates multiple crossover points 38 between which are open lobes 40 in which the beams 14 can be secured.

Figure 3A:
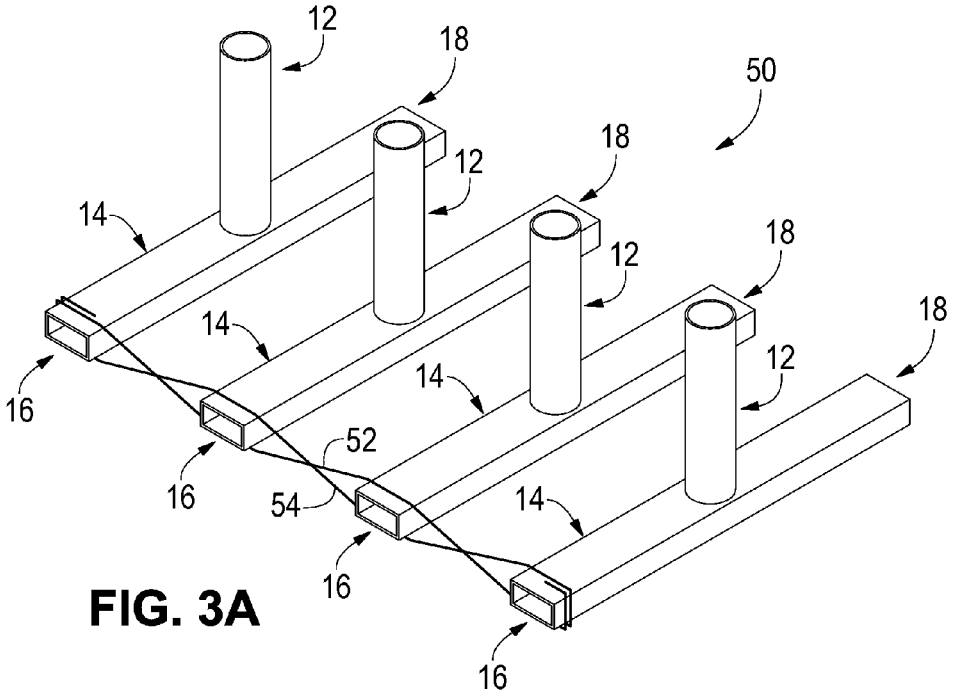
FIG. 3A is a perspective view of a third embodiment of a bollard system.
Figure 3B:
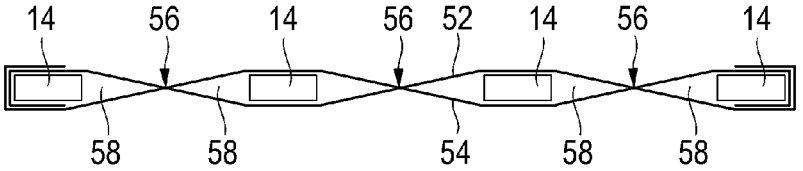
FIG. 3B is a schematic end view of support beams and woven reinforcement bars of the system of FIG. 3A.
Figure 3C:
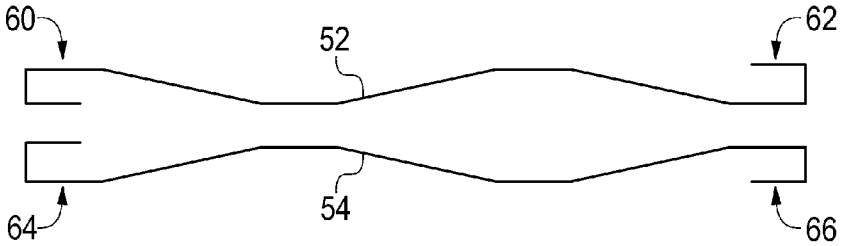
FIG. 3C is a schematic end view of the woven reinforcement bars shown in FIG. 3B.

Referring next to FIG. 3A, a bollard system 50 includes bollards 12 that are attached near the centers of support beams 14. Woven between at least the front ends 16 of the beams 14 are two reinforcing bars 52 and 54. The reinforcing bars 52, 54 can each have a construction similar to that of the reinforcing bar 20 shown in FIG. 1. As is shown most clearly in FIG. 3C, however, each reinforcing bar 52, 54 has a generally sinusoidal shape so that, when the bars are inverted relative to each other as indicated in FIG. 3C, they together form a weaving pattern similar to that formed by the single reinforcing bars 20 and 32 of FIGS. 1 and 2 (see FIG. 3B). Described another way, if both bars 52, 54 are considered to trace the general shape of a sine wave, the two bars can be oriented such that the waves are 180° out of phase with each other. As is apparent from FIG. 3B, this results multiple crossover points 56 between which are open lobes 58 in which the support beam 14 can be secured.

The first reinforcing bar 52 has first and second free ends 60 and 62, respectively, and the second reinforcing bar 54 has first and second free ends 64 and 66, respectively. In similar manner to the free ends 34, 36 of the embodiment of FIG. 2, the first free ends 60, 64 of the bars 52, 54 form hooks that wrap around one of the beams 14 (the leftmost beam in FIGS. 3A and 3B) and create an overlapping region in which the ends run parallel to each other. In addition, the second free ends 62, 66 of the bars 52, 54 form hooks that wrap around another of the beams 14 (the rightmost beam in FIGS. 3A and 3B) and create an overlapping region in which the ends run parallel to each other. As before, the overlapping regions provide resistance to tensile forces.

Figure 4A:
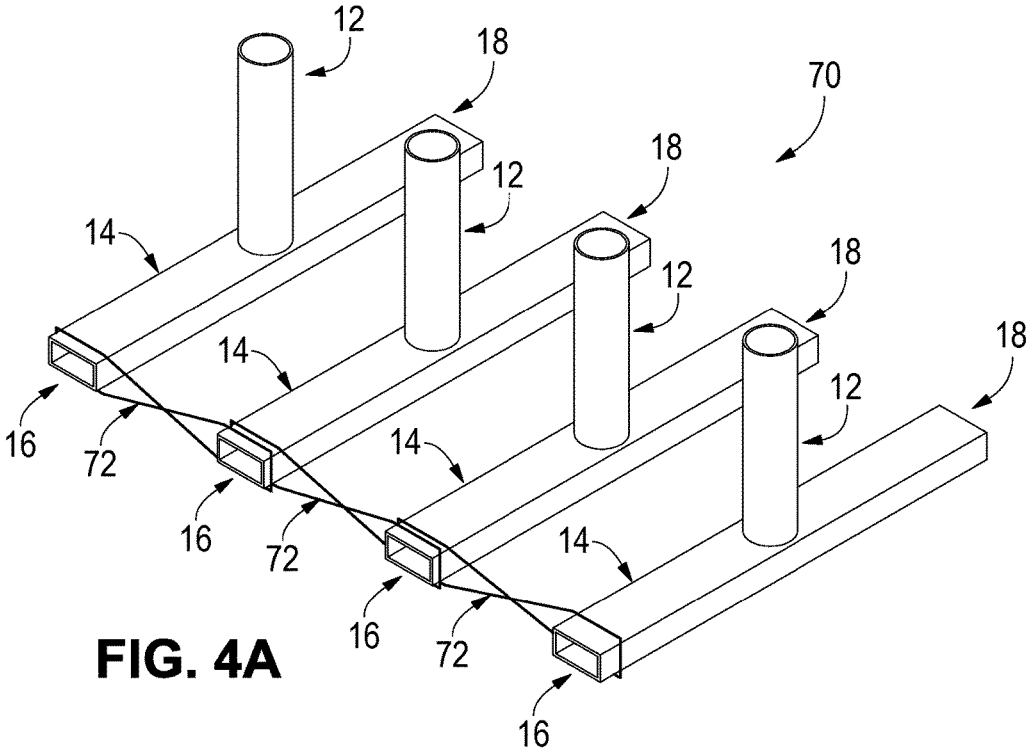
FIG. 4A is a perspective view of a fourth embodiment of a bollard system.
Figure 4B:
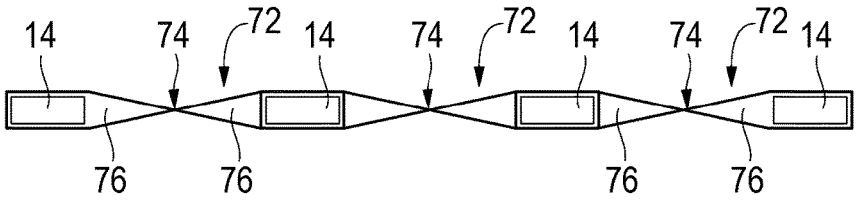
FIG. 4B is a schematic end view of support beams and woven reinforcement bars of the system of FIG. 4A.
Figure 4C:
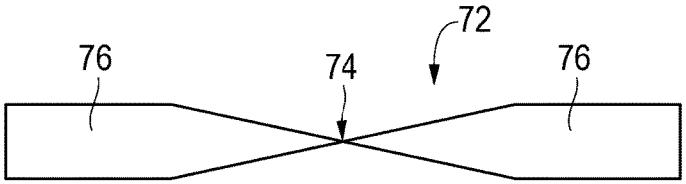
FIG. 4C is a schematic end view of a woven reinforcement bar shown in FIG. 4B.

With reference next to FIG. 4A, a bollard system 70 includes bollards 12 that are attached near the centers of support beams 14. Woven between at least the front ends 16 of the beams 14 are multiple reinforcing bars 72. More particularly, there are three reinforcing bars 72 woven between the beams 14 because there are four such beams to be reinforced. The reinforcing bars 72 can each have a construction similar to that of the reinforcing bar 20 shown in FIG. 1. Like the reinforcing bar 20, the reinforcing bars 72 each comprise an endless bar that can be passed over the beams 14. However, unlike the reinforcing bar 20, the reinforcing bars 72 are each only configured to wrap around two adjacent support beams 14. As is illustrated most clearly in FIG. 4C, each reinforcing bar 72 forms a single crossover point 74 so as to form and endless curve having two lobes 76. This curve can be described as a "figure-8" shape. Although the reinforcing bars 72 do not weave individually between each of the beams as in previously described embodiments, the same result occurs because, as shown in FIG. 4A, the reinforcing bars 72 overlap each other. More particularly, the lobes 76 of adjacent reinforcing bars 72 overlap multiple beams 14 and each other across the foundation. As can be appreciated from FIG. 4A, in order to achieve this overlap, each reinforcing bar 72 can be angled relative to the support beams 14 (i.e., so they are not exactly perpendicular to the beams) to make space for two lobes 76 on individual beams.

Figure 5A:
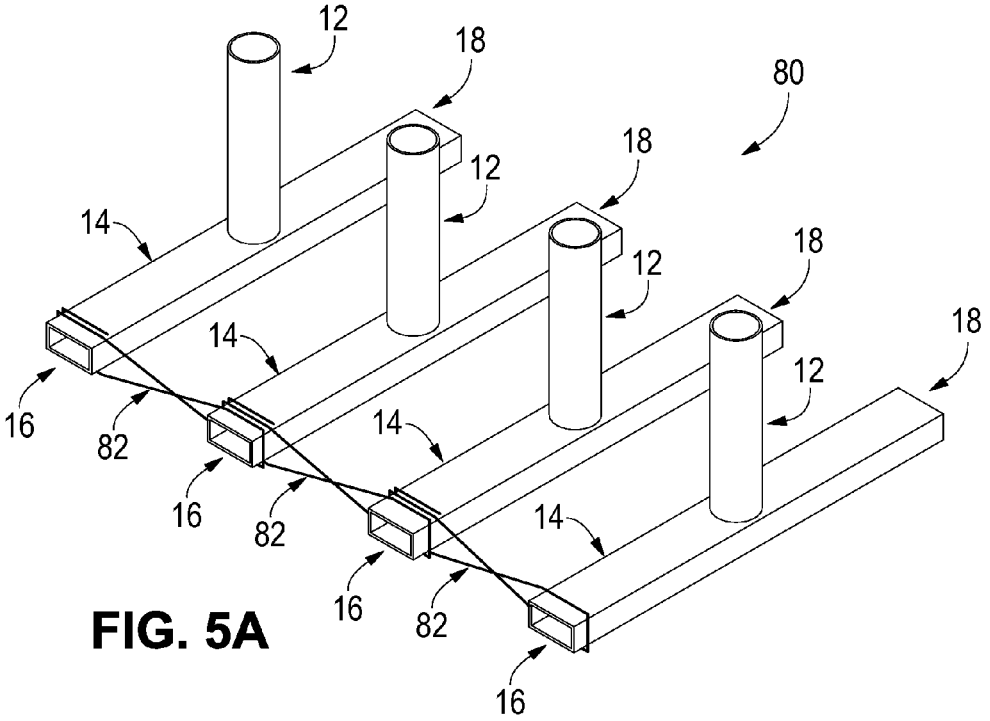
FIG. 5A is a perspective view of a fifth embodiment of a bollard system.
Figure 5B:
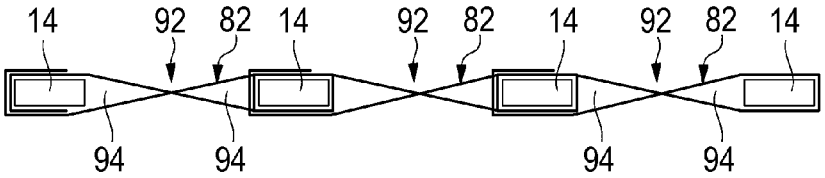
FIG. 5B is a schematic end view of support beams and woven reinforcement bars of the system of FIG. 5A.
Figure 5C:
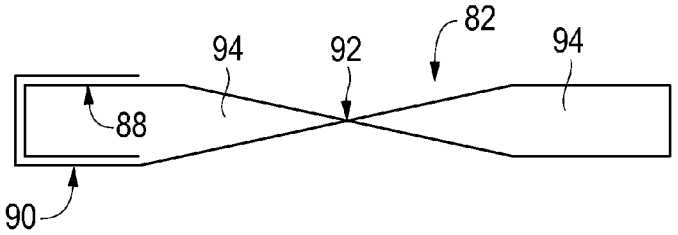
FIG. 5C is a schematic end view of a woven reinforcement bar shown in FIG. 5B.

Referring next to FIG. 5A, a bollard system 80 includes bollards 12 that are attached near the centers of support beams 14. Woven between at least the front ends 16 of the beams 14 are multiple reinforcing bars 82. More particularly, there are three reinforcing bars 82 because there are four support beams 14 to be reinforced. The reinforcing bars 82 share similarities with both the reinforcing bar 32 of FIG. 2 and the reinforcing bars 72 of FIG. 4. In particular, the reinforcing bars 82 each have free ends 88 and 90 that form hooks that wrap around a beam 14 (see FIG. 5B) like the reinforcing bar 32. In addition, the reinforcing bars 82 each form a "figure-8 shape" having a single crossover point 92 and two lobes 94 (see FIG. 5C) like the reinforcing bars 72. As can be appreciated from FIG. 5A, in order to achieve this overlap, each reinforcing bar 82 is angled relative to the support beams 14 to make space for two lobes 94 on individual beams.

Figure 6A:
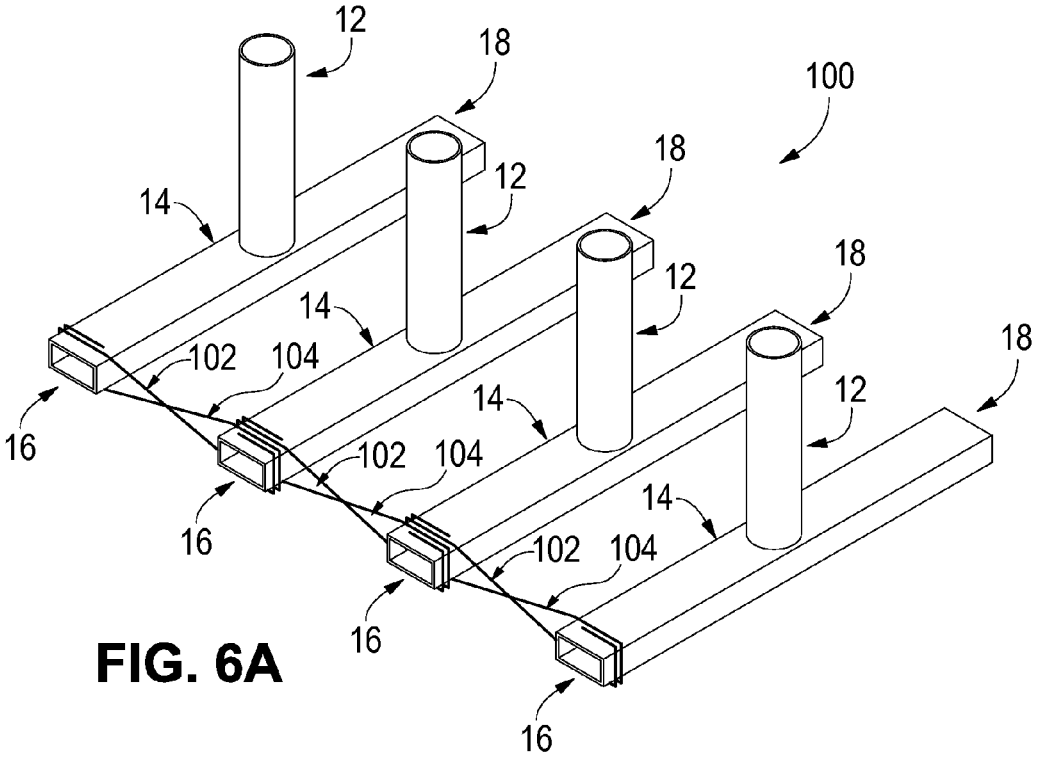
FIG. 6A is a perspective view of a sixth embodiment of a bollard system.
Figure 6B:
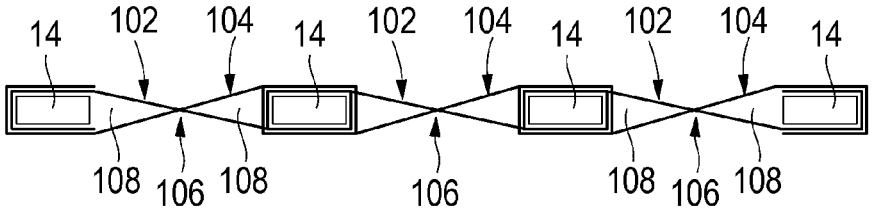
FIG. 6B is a schematic end view of support beams and woven reinforcement bars of the system of FIG. 6A.
Figure 6C:
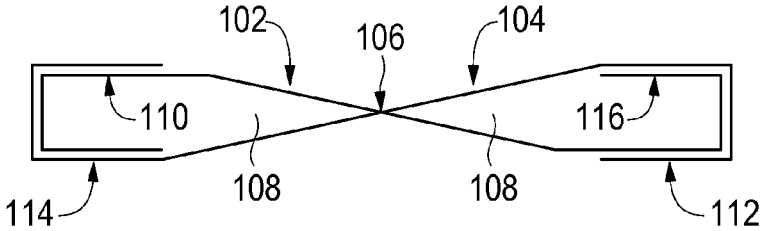
FIG. 6C is a schematic end view of a woven reinforcement bar shown in FIG. 6B.

Turning to FIG. 6, a bollard system 100 includes bollards 12 that are attached near the centers of support beams 14. Woven between at least the front ends 16 of the beams 14 are multiple pairs of reinforcing bars 102 and 104, three pairs being provided reinforce tie the four support beams. Individually, each reinforcing bar 102, 104 forms an S-shape, which can be seen most clearly in FIG. 6C. However, when the reinforcing bars 102, 104 are inverted relative to each other as in FIG. 4C and paired together as in FIG. 6B, they each form a figure-8 shape having a single crossover point 106 and two lobes 108 (see FIG. 6C) like the reinforcing bars 72. Similar to the reinforcing bars 52, 54 shown in FIG. 3, the first reinforcing bar 102 has first and second free ends 110 and 112, respectively, and the second reinforcing bar 104 has first and second free ends 114 and 116, respectively. The first free ends 110, 114 of the bars 102, 104 form hooks that wrap around one of the beams 14 and the second free ends 112, 116 of the bars form hooks that wrap around another of the beams 14 to form overlapping regions at each of the beams. As can be appreciated from FIG. 6A, the pairs of reinforcing bars 102, 104 can be angled relative to the support beams 14 to make space for two lobes 108 on individual beams.

Figure 7A:
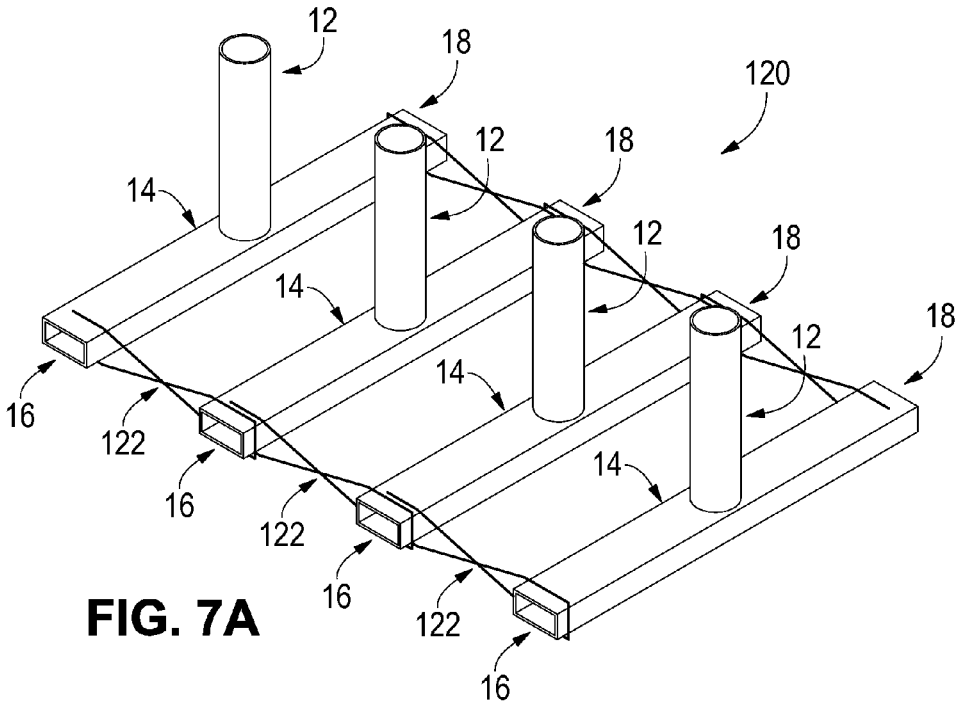
FIG. 7A is a perspective view of a seventh embodiment of a bollard system.
Figure 7B:
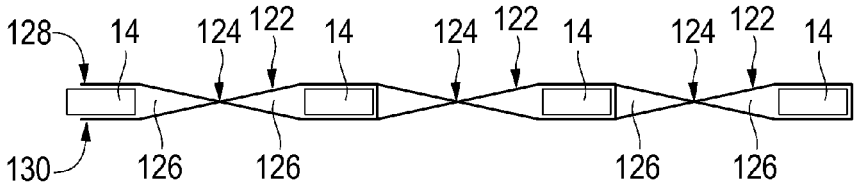
FIG. 7B is a schematic end view of support beams and woven reinforcement bars of the system of FIG. 7A.
Figure 7C:
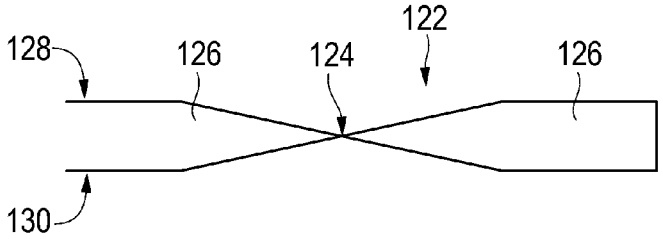
FIG. 7C is a schematic end view of a woven reinforcement bar shown in FIG. 7B.

FIG. 7 illustrates a further bollard system 120 that includes bollards 12 that are attached near the centers of support beams 14. Woven between at least the front ends 16 of the beams 14 are multiple reinforcing bars 122. More particularly, there are three reinforcing bars 122 because there are four support beams 14 to be reinforced. The reinforcing bars 122 are similar to the reinforcing bars 82 shown in FIG. 5 because they each comprise a single bar that forms a figure-8 shape having a single crossover point 124, two lobes 126, and two free ends 128 and 130. Unlike the reinforcing bars 82, however, the free ends 128, 130, do not form hooks that wrap around a support beam 14. Instead, the free ends 128, 130 are attached (e.g., welded) to the top and bottom of the support beam 14, respectively. Because of this, there is no need to form an overlap between the two free ends 128, 130. In some embodiments, a reinforcing bar 122 can be attached to each support beam 14 of the system 130 except for the last beam (the rightmost beam in the example of FIG. 7A) prior to shipping the system 120 to the installation site. In such a case, assembly of the system 130 is simplified. As can be appreciated from FIG. 7A, each reinforcing bar 122 can be angled relative to the support beams 14 to make space for two lobes 126 on individual beams.

The invention claimed is:

1. A bollard system comprising:

multiple support beams adapted to be embedded in concrete;

multiple bollards, each bollard being attached to a support beam a point near a center of the beam; and a reinforcing bar that is woven between the support beams to provide reinforcement to the system, wherein the reinforcing bar alternately passes over and under adjacent support beams in a first direction that is generally perpendicular to the beams.

2. The system of claim 1, wherein the support beams are elongated hollow beams.

3. The system of claim 1, wherein the bollards are elongated pipes or tubes.

4. The system of claim 1, wherein the reinforcing bar is made of steel.

5. The system of claim 1, wherein the reinforcing bar also alternately passes under and over adjacent support beams in a second direction that is opposite to the first direction.

6. The system of claim 1, wherein the reinforcing bar alternately passes over and under more than two support beams.

7. The system of claim 1, wherein the reinforcing bar forms a crossover point at which the bar crosses over itself and lobes in which support beams can be received.

8. The system of claim 1, wherein the reinforcing bar is an endless bar having no free ends.

9. The system of claim 1, wherein the reinforcing bar has free ends that form hooks that wrap around the same support beam.

10. The system of claim 1, wherein the system comprises two reinforcing bars having similar shapes that are used as a pair, the reinforcing bars alternately passing over and under support beams in a manner in which they form crossover points at which they cross over each other and lobes in which support beams can be received.

11. The system of claim 1, wherein the system includes multiple reinforcing bars, each bar forming a single crossover point at which the bar crosses over itself and two lobes in which support beams can be received, wherein the bars are applied to the support beams in a manner in which the bars overlap each other.

12. The system of claim 1, wherein the reinforcing bar has free ends that are attached to the same support beam.

13. A bollard system comprising:

multiple horizontal support beams adapted to be embedded in concrete;

multiple vertical bollards extending upward from the support beams, each bollard being attached to a beam near a halfway point along a length of the beam; and a reinforcing bar that is woven between the support beams to provide reinforcement to the system, wherein the reinforcing bar alternately passes over and under adjacent beams in a first direction that is generally perpendicular to the beams.

14. The system of claim 13, wherein the reinforcing bar also alternately passes under and over adjacent support beams in a second direction that is opposite to the first direction.

15. The system of claim 13, wherein the reinforcing bar alternately passes over and under more than two support beams.

16. The system of claim 13, wherein the reinforcing bar forms a crossover point at which the bar crosses over itself and lobes in which support beams can be received.

17. The system of claim 13, wherein the system comprises two reinforcing bars having similar shapes that are used as a pair, the reinforcing bars alternately passing over and under support beams in a manner in which they form crossover points at which they cross over each other and lobes in which support beams can be received.

18. The system of claim 13, wherein the system includes multiple reinforcing bars, each bar forming a single crossover point at which the bar crosses over itself and two lobes in which support beams can be received, wherein the bars are applied to the support beams in a manner in which the bars overlap each other.

19. The system of claim 13, wherein the reinforcing bar has free ends that are attached to the same support beam.

20. A method for supporting bollards, the method comprising:

attaching each bollard to a support beam at a point near a center of the beam; and weaving a reinforcing bar between the beams to provide reinforcement, wherein the reinforcing bar alternately passes over and under adjacent support beams in a first direction that is generally perpendicular to the beams.

* * * * *